United States Patent [19]

Tikes et al.

[11] Patent Number: 4,970,432

[45] Date of Patent: Nov. 13, 1990

[54] TRAVELLING WAVE TUBE WITH COUPLING DEVICE BETWEEN ITS DELAY LINE AND EXTERNAL MICROWAVE CIRCUITS

[75] Inventors: Jacques Tikes, Orsay; Dominique Henry, Elancourt; Joël Le Fur, Chilly-Mazarin, all of France

[73] Assignee: Thomson-CSF, Puteaux, France

[21] Appl. No.: 339,994

[22] Filed: Apr. 18, 1989

[30] Foreign Application Priority Data

Apr. 19, 1988 [FR] France ..... 88 05139

[51] Int. Cl.[5] ..... H01J 23/42; H01J 25/34

[52] U.S. Cl. ..... 315/3.5; 315/3.6; 315/39.3

[58] Field of Search ..... 315/3.5, 3.6, 39, 39.3, 315/39.53; 333/21 R, 252

[56] References Cited

U.S. PATENT DOCUMENTS

| | | | |
|---|---|---|---|
| 2,636,948 | 4/1953 | Pierce | 315/3.6 |
| 2,758,244 | 8/1956 | Dodds | 315/3.5 |
| 2,788,465 | 4/1957 | Bryant et al. | 315/3.5 |
| 2,869,082 | 1/1959 | Harrison et al. | 333/21 R |
| 2,899,593 | 8/1959 | Wing et al. | 315/3.5 |
| 2,991,391 | 7/1961 | Beaver | 315/3.5 |
| 3,076,156 | 1/1963 | Muller et al. | 333/162 |
| 3,715,616 | 2/1973 | Elfe, Jr. | 315/3.6 X |
| 3,939,443 | 2/1976 | Biro et al. | 333/202 |
| 4,035,687 | 7/1977 | Gross | 315/3.6 X |

FOREIGN PATENT DOCUMENTS

| | | |
|---|---|---|
| 0274950 | 12/1987 | European Pat. Off. . |
| 1013730 | 8/1957 | Fed. Rep. of Germany . |
| 973327 | 1/1960 | Fed. Rep. of Germany . |
| 1184604 | 7/1959 | France . |
| 1434049 | 5/1964 | France . |
| 2485801 | 12/1981 | France . |

*Primary Examiner*—Eugene R. LaRoche
*Assistant Examiner*—Seung Ham
*Attorney, Agent, or Firm*—Oblon, Spivak, McClelland, Maier & Neustadt

[57] ABSTRACT

A travelling-wave tube has a cylindrical sleeve containing a delay line and a coupling device between the delay line and an external microwave circuit for removal or injection of microwave energy. This external circuit comprises a transmission line possessing a conductive internal core. A conductive part is placed at one end of the delay line. It has a coupling pin that projects inwards into the sleeve and is brazed to an end of the delay line. The conductive part is brazed to the sleeve. The coupling between the delay line and the external circuit is made between the part and the internal conductive core of the transmission line. This coupling is without contact, a narrow gap being prepared between the external surface of the part located on the side of the coupling pin and the internal conductive core.

10 Claims, 4 Drawing Sheets

FIG. 1 PRIOR ART
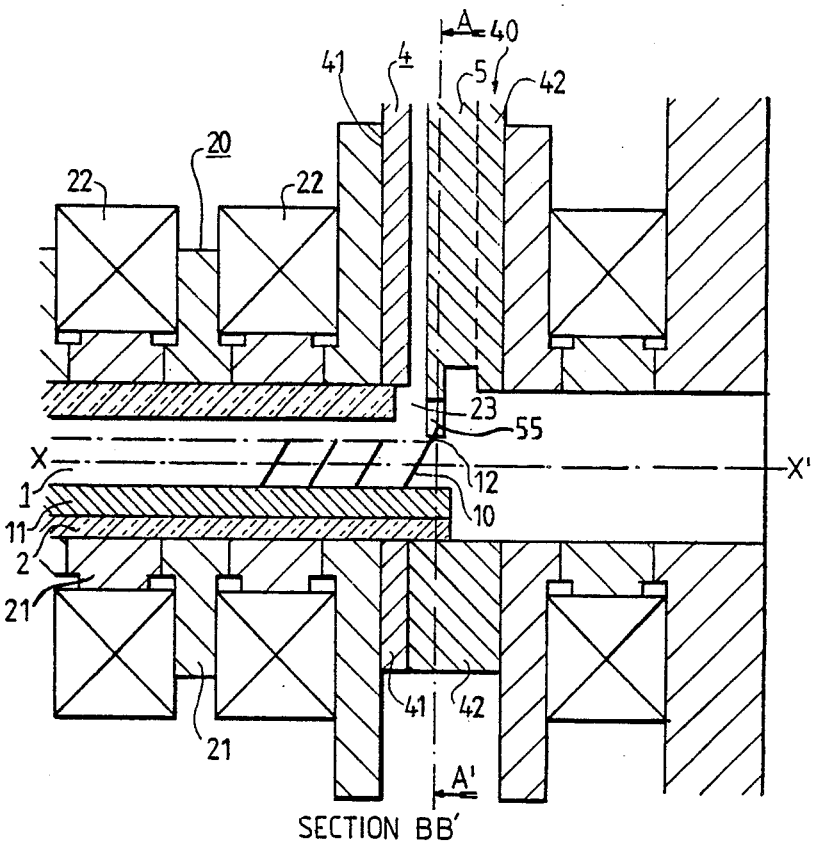
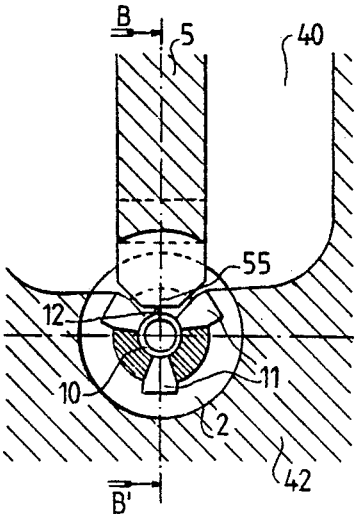
FIG. 2 PRIOR ART
SECTION AA'

SECTION BB'

SECTION AA'

FIG. 5a
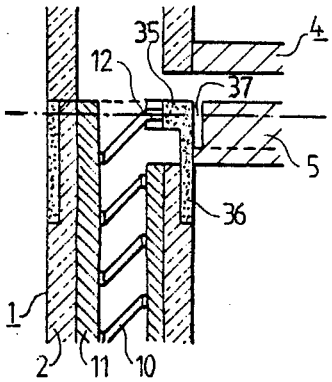
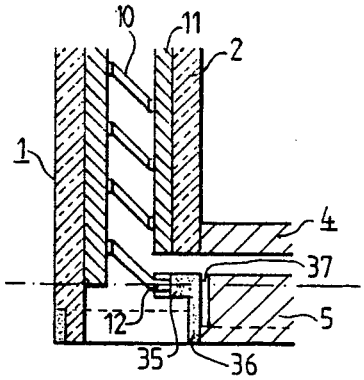
FIG. 5b
FIG. 6a
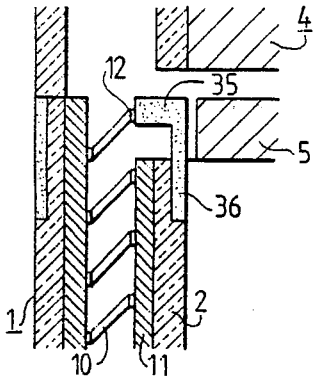
FIG. 6b
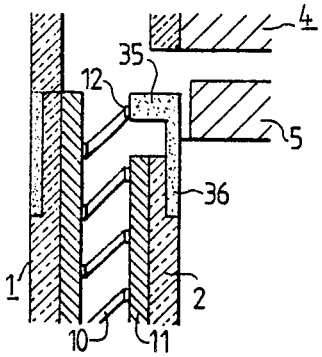
FIG. 6c
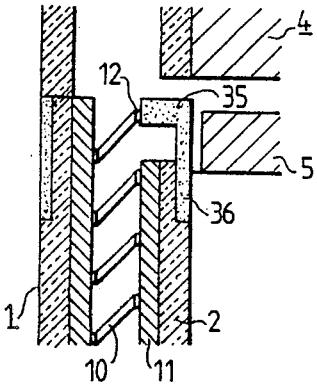

FIG. 7 SECTION BB'
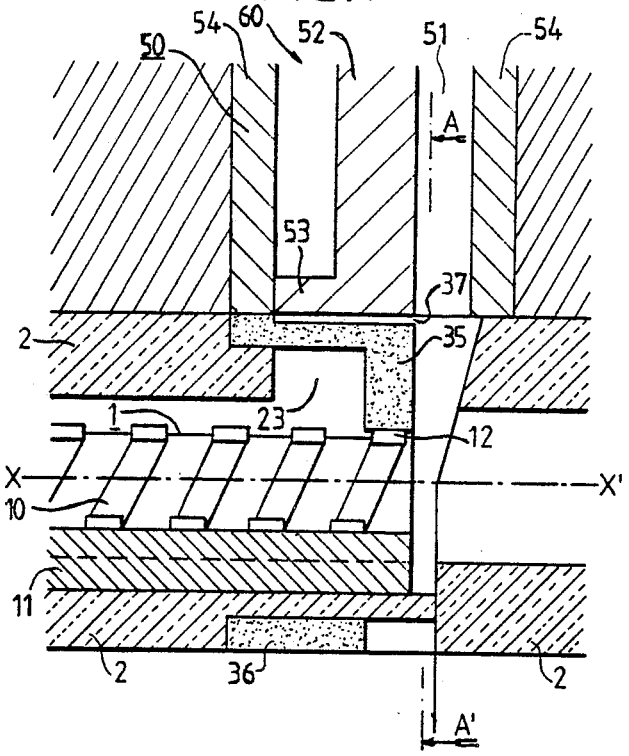
FIG. 8
SECTION AA'
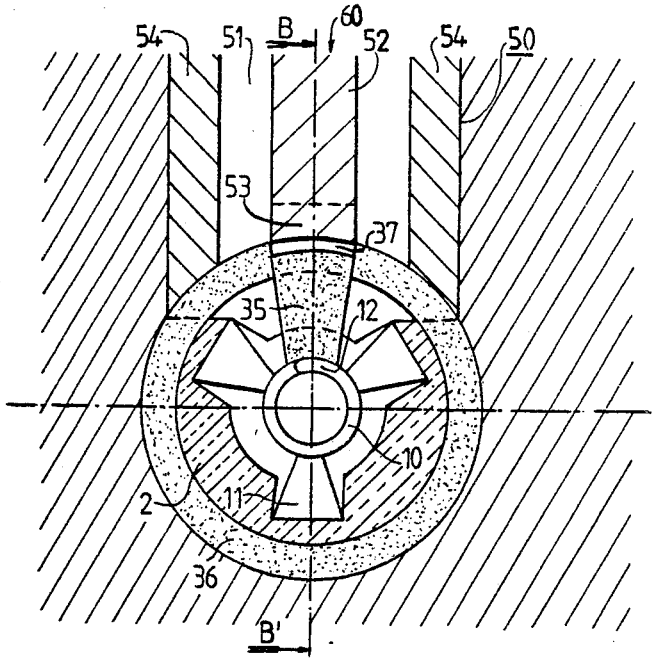

TRAVELLING WAVE TUBE WITH COUPLING DEVICE BETWEEN ITS DELAY LINE AND EXTERNAL MICROWAVE CIRCUITS

BACKGROUND OF THE INVENTION

1. Field of the Invention

The present invention concerns a travelling-wave tube including a delay line contained in a sleeve. It concerns, more particularly, a coupling device between the delay line of the tube and external circuits for injection or for removal of microwave energy into or from the tube.

The invention is particularly suited to power travelling-wave tubes with wide band, the delay line of which has a helix structure. It can also be applied to tubes for which the delay line is derived from the helix structure, for example so-called "ring and bar" or "ring and loop" delay lines.

2. Description of the Prior Art

A travelling-wave tube or TWP generally comprises:

an electron gun which produces a long and narrow beam of electrons, a delay line contained in a sleeve, where the interaction between the electron beam and a microwave takes place. This delay line is provided with a device for injection and a device for removal of microwave energy, a focusing device using permanent magnets placed around the delay line throughout its length. This focusing device creates a magnetic induction in the zone of interaction between the electron beam and the microwave, a collector which can collect the electron beam.

The injection of microwave energy, at the input of the delay line, is generally done by means of a coaxial connector, the injected energy level being low.

The amplified energy can be removed, at the output of the delay line, either by means of a ridged waveguide or by means of a coaxial element. This depends on the energy level present at the output of the delay line.

In all cases, the external surface for the injection and removal of microwave energy are specially designed to ensure the vacuum tightness of the interior of the travelling-wave tube.

A coupling device, between the delay line of a travelling-wave tube and the external microwave circuits is known, for example, from the French patent No. 2 485 801-B filed on 27th June 1980. In this patent, the delay line is a helix. At least one of its ends is connected to an external circuit. This external circuit has a transmission line possessing an internal conductive core. The connection is made by means of a coupling pin. The coupling pin is solidly joined to one side of the internal conductive core of the transmission line. On the other side, the coupling pin is brazed to the end of the helix. In this patent, the transmission line is either a ridged waveguide, the conductive internal core being the ridge, or it is a coaxial line, the conductive internal core being the central conductor of this line.

When assembling TWTs, it is seen that the point where the coupling pin should be brazed, at the end of the helix, is not easily reached. Furthermore, the dimensions of the helix and of the coupling pin are very small. The measurements to be made to ascertain that the TWT conforms to requirements can be done only after the helix/coupling pin junction has been made. Since the connection between these two parts is a brazing, it cannot be disconnected. This means that, if there is a defect in one of the parts forming either the delay line or the focusing device or the external microwave circuits, the entire unit will be rejected.

The present invention is aimed at overcoming these drawbacks. It proposes to establish mechanical independence between the delay line and the external circuits for the injection or removal of the microwave energy into or from a travelling-wave tube.

For this purpose, the coupling pin, which, in the prior art, was joined solidly to the conductive internal core of the transmission line, will be kept solidly joined to a conductive part. The conductive part is fixed to the sleeve surrounding the delay line. The coupling pin is solidly joined to the conductive part and is fixed to the end of the delay line. It is through the external surface of the part that the electromagnetic coupling between the delay line and the conductive core of the transmission line is made.

During the assembly of TWTs using the device according to the invention, it is possible to identify defects, if any, in the elements forming either the delay line or the focusing device or the external circuits, before the assembly is finalized. Measurements can be made between the delay line and the external circuits without the assembly of these parts having been finalized. The defective elements alone will be rejected. The cost of fabrication of the TWTs used in this coupling device will be reduced.

SUMMARY OF THE INVENTION

An object of the invention, therefore, is a travelling-wave tube having a cylindrical sleeve containing a delay line and a coupling device between the delay line and an external microwave circuit, said microwave circuit comprising a transmission line possessing a conductive internal core, said coupling device comprising:

a conductive part placed at one end of the delay line and having a coupling pin that projects inwards into the sleeve and is fixed to the end of the delay line, the part being brazed to an end of the sleeve, and the internal conductive core of the transmission line having an end located so that it faces the external surface of the part, the microwave electromagnetic coupling being done between the external surface of the part and the internal conductive core.

The end of the internal conductive core of the transmission line is placed in the vicinity of the coupling pin.

Preferably, a narrow gap is made between the end of the internal conductive line of the transmission line and the external surface of the conductive part. This gap makes it possible to get rid of problems of poor contact.

This narrow gap is preferably about 0.1 millimeter.

The conductive part will preferably take the shape of an embedded ring around the sleeve.

The external microwave circuit comprises, preferably, a ridged waveguide, with the internal conductive core being the ridge, or a coaxial line, with the internal conductive core being the central conductor of the coaxial line.

BRIEF DESCRIPTION OF THE DRAWINGS

The invention will be better understood, and other characteristics and advantages will appear from the reading of the following description and the figures related to it, of which:

FIG. 1 shows a partial sectional view of a TWT using a coupling device between a delay line with a helix structure and a ridged waveguide according to the prior art;

FIG. 2 shows a cross-section of the same TWT;

FIG. 5*a* shows a partial sectional view of a TWT according to the invention, the delay line and the ridge being located on one and the same side of the axis of the ridged waveguide;

FIG. 5*b* shows a partial sectional view of a TWT according to the invention, the delay line and the ridge being located on either side of the axis of the ridged waveguide;

FIGS. 6*a* to 6*c* show partial sectional views of a TWT according to the invention, the position of the conductive part varying vertically with respect to the position of the ridge;

FIG. 7 shows a partial sectional view of a TWT using a coupling device between a delay line with a helix structure and a coaxial line according to the invention;

FIG. 8 shows a cross-section of the same TWT.

In the different figures, the corresponding elements are designated by the same references. The dimensions of the different elements are not kept to, for reasons of clarity.

DESCRIPTION OF PREFERRED EMBODIMENTS

Figure 3:
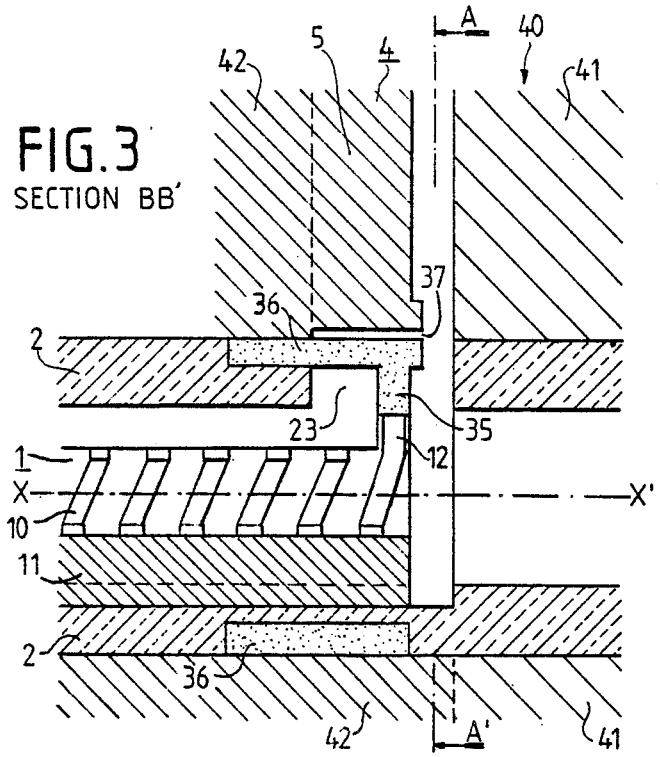
FIG. 3 shows a partial sectional view of a TWT using a coupling device between a delay line with a helix structure and a ridged waveguide according to the invention.

FIG. 1 shows a partial longitudinal section of a travelling-wave tube according to the prior art.

FIG. 2 shows a sectional view, along the plane AA', of the travelling-wave tube shown in FIG. 1. FIG. 1 also shows a longitudinal section of FIG. 2, along the plane BB'.

The travelling-wave tube represented comprises a delay line 1 and an external circuit 40 for the removal of microwave energy from the tube.

The delay line 1 is formed by a helix 10 with an axis XX'. Rods 11 ensure the centering of the helix 10 in a metallic cylindrical sleeve 2. The sleeve 2 ensures the vacuum tightness of the interior of the travelling-wave tube. It is generally grounded. The rods 11 may be made of quartz, alumina, glucina, boron nitride, etc. They may be brazed or clamped against the helix 10.

The travelling-wave tube also has a focusing device 20. The delay line 1 is placed within the focusing device 20. It is formed by the succession, along the axis XX', of alternating permanent magnets 22 and pole pieces 21. These permanent magnets 22 and these pole pieces 21 are annular. They surround the cylindrical sleeve 2 and extend beyond its length.

An external circuit 40 for the removal of the microwave energy from the travelling-wave tube is coupled to the delay line 1. In our example, this external circuit is formed by a rectangular ridged waveguide 4. Its axis is perpendicular to the axis XX'. This waveguide 4 goes through the focusing device 20 until it comes into contact with the sleeve 2. The width of the waveguide is contained in the thickness, along the axis XX', of one of the magnets 22. The waveguide 4 has a ridge 5 throughout its length. It projects perpendicularly to one of the large sides of the waveguide 4 at its middle. The ridge 5 is extended on the delay line 1 side by a coupling pin 55. The sleeve 2 has, on the side where the waveguide 4 arrives, an aperture 23, enabling the coupling pin 55 to pass through. The coupling pin 55 extends up to the delay line 1, and it is brazed to the end 12 of the helix 10.

At the end of the ridged waveguide 4, opposite to the junction with the delay line 1, it is possible to use many devices for connection with one coaxial line or another waveguide for example. The vacuum tightness of the interior of the ridged waveguide should be provided by an appropriate device. The waveguide 4 may be formed by the assembly of a U-shaped part 42, including the ridge 5, and a part 41 forming a cover. The pole pieces can be soldered or brazed to the ridged waveguide 4.

The mounting of all these elements is done in several steps:

the positioning and fixing of that part of the focusing device 20 which is adjacent to the cover 41 of the waveguide 4.

positioning and fixing of that part of the focusing device 20 which is adjacent to the part 42 of the waveguide 4 comprising the ridge 5.

brazing of the helix 10 to the rods 11, and then into the sleeve 2.

brazing of the helix set 10/sleeve 2 assembly in the part of the focusing device 20 connected to the cover 41 of the waveguide 4.

assembly of the two parts 41, 42 of the waveguide 4 and joining, by brazing, of the end 12 of the helix 10 and the coupling pin 55. The performance of this latter brazing operation is very delicate because it is not easily accessible.

It is only after all these steps that it is possible to start the measurements for checking the travelling-wave tube. If one part is defective, the entire unit will be rejected.

We shall now describe the modifications provided by the invention.

FIG. 3 shows a partial view, in longitudinal section, of a travelling-wave tube according to the invention.

Figure 4:
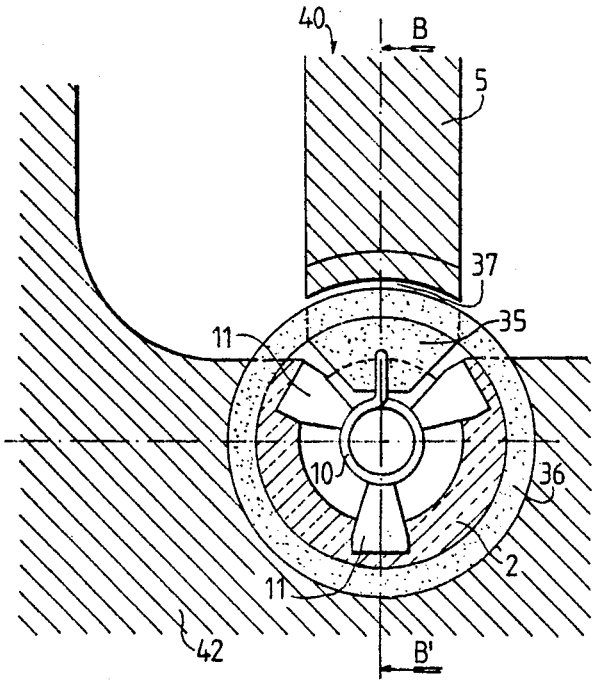
FIG. 4 shows a cross-section of the same TWT.

FIG. 4 shows a cross-section, along the plane AA', of the travelling-wave tube shown in FIG. 3. FIG. 3 also shows a longitudinal section of FIG. 4 along the plane BB'.

The travelling-wave tube shown has a delay line 1 with an axis XX' and an external circuit 40 for the removal of the microwave energy from the tube.

These two figures represent a zone in the vicinity of the end of the delay line 1: the rest of the construction may be identical to that described with reference to FIGS. 1 and 2. In particular, the focusing device has not been shown.

In this embodiment, the delay line 1 is a line with a helix 10. The helix 10 is held by rods 11 in a metallic sleeve 2. An external circuit 40, for the removal of microwave energy from the travelling-wave tube, is coupled to the delay line 1. This circuit is a ridged waveguide 4. Its axis is perpendicular to the axis XX'. This waveguide 4 goes through the focusing device until it comes into contact with the sleeve 2. The waveguide 4 possesses a ridge 5 all along its length. However, in this embodiment, the ridge 5 does not have any coupling pin, as in the prior art, on the side of the coupling with the delay line 1.

The waveguide 4 may consist of a cover 41 and a U-shaped part 42 having the ridge 5.

A conductive part 36 is placed at one end of the delay line 1 on the side of the coupling with the external circuit 40 for the removal of microwave energy from the travelling-wave tube. It is brazed to the sleeve 2. In the figure, the part 36 has the shape of a ring embedded in the external wall of the sleeve 2.

A coupling pin 35 is solidly joined to the conductive part 36. This coupling pin 35 projects towards the interior of the sleeve 2 and is brazed to the end 12 of the helix. The sleeve 2 still has an aperture 23 in the zone of the coupling with the external circuit 40 for the removal of microwave energy from the travelling-wave tube. This aperture 23 is in the vicinity of the coupling pin 35.

A narrow gap 37 is prepared between the end of the ridge 5, placed on the side of the delay line 1 and the external surface of the ring 36 located at the level of the coupling pin 35. There is no longer any mechanical contact between the helix 10 and the ridge 5 and the electromagnetic coupling is provided by capacitive effect between the external surface of the conductive ring 36 and the ridge 5.

A conductive part having a shape other than that of a ring could have been used. The coupling ring 35 could have been solidly joined to a rod embedded in the sleeve. A ring-shaped conductive part is simple to make and assemble.

Measurements have shown that the electrical quality of the junction does not depend on the value of the gap 37, provided that it is small enough.

Couplings could have been made in the frequency bands ranging from the decimetric wave band to the millimetric wave band, in retaining the same narrow gap 37. The value of this gap is about 0.1 millimeters. A gap of 0.1 millimeters is easy to make with satisfactory tolerance.

The assembly of the TWTs including a coupling device according to the invention is simplified. The following are the assembling steps:

the positioning and fastening of that part of the focusing device which is adjacent to the cover 41 of the waveguide 4, positioning and fastening of that part of the focusing device which is adjacent to the ridged part 42 of the waveguide 4, brazing of the helix 10 to the rods 11 and then to the assembly comprising the sleeve 2 and the ring 36. The ring 36 is brazed beforehand to the sleeve 2. The end of the helix 10 is brazed to the coupling pin 35 at this step. This brazing is easy to make, and the brazing spot is completely accessible, assembling of the two parts comprising the focusing device/waveguide, assembling and brazing of the assembly comprising the sleeve 2, the ring 36 and the helix 10, with the assembly comprising the focusing device and the waveguide 4. This latter step does not raise any particular problems.

The measurements to be made, in order to check the proper functioning of the different elements, can take place before the latter step when the unit is put in the furnace. The defective parts can be rejected before final assembly. Furthermore, the helix will undergo one cycle less in the furnace, than it would in the prior art. This is an advantage because the brazing operations are difficult to perform.

FIGS. 5*a* and 5*b* give a sectional view of two alternative embodiments of the ring 36. The ring 36, shown in FIG. 5*a*, is more particularly adapted to a case where the helix 10 and the ridge 5 are located on the same side of the axis of the waveguide 4. The ring 36 shown in FIG. 5*b* is more particularly adapted to the case where the helix 10 and the ridge 5 are located on either side of the axis of the waveguide 4.

FIGS. 6*a*, 6*b* and 6*c* show that it is possible to make heightwise variations of the position of the ring 36 with respect to that of the ridge 5. This variation enables adjustment of the characteristic impedance. In FIG. 6*a* the pin 35 and the ridge 5 have the same height. In FIG. 6*b*, the pin 35 is lower than the ridge 5. In FIG. 6*c*, the pin 35 is higher than the ridge 5.

FIG. 7 shows a partial longitudinal sectional view of another embodiment of a travelling-wave tube according to the invention.

FIG. 8 is a cross-section, in the plane AA', of the travelling-waveguide shown in FIG. 7. FIG. 7 is a longitudinal section of FIG. 8, in the plane BB'.

The travelling-wave tube shown comprises a delay line 1 with an axis XX' and an external circuit 60 for the removal of microwave energy from the travelling-wave tube. The two figures show only a zone in the vicinity of the end of the delay line 10, and the rest of the construction may be identical to that described in FIGS. 1 and 2. In particular, the focusing device is not shown.

These figures again show the same delay line 1, with an axis XX', as the one described with reference to FIGS. 3 and 4. The conductive part 36, bearing the coupling pin 35, is placed at its end. It too is a ring. However, the external circuit 60 for the removal of energy from the tube is a coaxial line 50. It is formed by a central conductor 52 and an external conductor 54 shaped like a hollow cylinder, with a dielectric 51 between them. The axis of the coaxial line is perpendicular to the axis XX' of the delay line 1. The coaxial line 50 goes through the focusing device until it is in contact with the sleeve 2. The sleeve 2 has an aperture 23 in the zone of coupling with the coaxial line 50. A narrow gap 37 is prepared between the end 53 of the central conductor 52, placed on the side of the delay line 1 and the external surface of the ring 36, at the level of the coupling pin 35.

The invention can be applied to the coupling of external circuits for the removal of microwave energy, as just described, as well as to the coupling of external circuits for the injection of microwave energy into the delay line. In this latter case, the part carrying the coupling pin will be on the other side of the delay line, on the electron gun side. The external circuit for the injection of energy is generally a coaxial line. The coupling will be identical to that described with reference to FIGS. 7 and 8.

The invention can also be applied to travelling-wave tubes, the delay line of which is a structure derived from the helix structure, for example consisting of rings connected to one and another by bars. These structures are known as "ring and bar" or "ring and loop" structures. The travelling-wave tube, including the coupling device according to the invention, may be used as a crossed-field amplifer.

Measurements have been made in millimetric bands with a travelling-wave tube using a coupling device according to the invention. They gave the following results:

passband 15%, standing wave ratio $<1.4$.

The passband of the junction may be widened to about 67% (i.e. one octave) with a standing wave ratio smaller than 1.7.

What is claimed is:

1. A travelling-wave tube having a metallic cylindrical sleeve containing a delay line and a coupling device between said delay line and an external microwave circuit, said microwave circuit comprising a transmission line possessing an internal conductive core, said coupling device comprising a conductive part fixed to the sleeve and a coupling pin projecting inward into the sleeve, said pin having a first end fixed to one end of the delay line and a second end fixed to the conductive part, said internal conductive core having an end located so that it directly faces the external circuit of said conductive part, said internal conductive core and said conductive part being mechanically independent, an electromagnetic coupling being established between the external circuit of said conductive part and said internal conductive core.

2. A travelling-wave tube according to claim 1, wherein the end of the internal conductive core of the transmission line is placed in the vicinity of the coupling pin.

3. A travelling-wave tube according to claim 2, wherein a narrow gap is made between the end of the internal conductive line of the transmission line and the external surface of the conductive part.

4. A travelling-wave tube according to claim 3, wherein the width of the narrow gap between the end of the internal conductive line of the transmission line and the external surface of the conductive part is about 0.1 millimeter.

5. A travelling-wave tube according to claim 1, wherein the conductive part has the shape of a ring embedded in the external wall of the sleeve.

6. A travelling-wave tube according to claim 1, wherein the external microwave circuit is a circuit for injection or a circuit for removal of microwave energy.

7. A travelling-wave tube according to claim 6, wherein the transmission line is a ridged waveguide, the internal conductive core being the ridge of the waveguide.

8. A travelling-wave tube according to claim 6, wherein the transmission line is a coaxial line, the internal conductive core being the central conductor of the coaxial line.

9. A travelling-wave tube according to claim 1, wherein the delay line is a helix line or a line of a type derived from the helix structure.

10. A travelling-wave tube according to claim 9, wherein the coupling pin is brazed to the end of the helix or to the end of the helix-derived structure.

* * * * *